US005549490A

United States Patent [19]

Buetas

[11] Patent Number: 5,549,490

[45] Date of Patent: Aug. 27, 1996

[54] MODULAR CONNECTOR SYSTEM

[76] Inventor: Eduardo R. Buetas, Passeig De 1'Estacio 14, Tarragona, Spain, 43800-Valls

[21] Appl. No.: 322,305

[22] Filed: Oct. 4, 1994

[30] Foreign Application Priority Data

Nov. 26, 1993 [ES] Spain ..... 9303140

[51] Int. Cl.[6] ..... H01R 11/09

[52] U.S. Cl. ..... 439/724; 439/721

[58] Field of Search ..... 439/721, 722, 439/723, 724, 709–717, 701

[56] References Cited

U.S. PATENT DOCUMENTS 3,670,295 6/1972 Ege et al. ..... 439/721

4,429,943 2/1984 Inoue ..... 439/721

5,295,847 3/1994 Ozaki et al. ..... 439/724

5,391,096 2/1995 Chiron et al. ..... 439/724

*Primary Examiner*—Hien D. Vu

*Attorney, Agent, or Firm*—Dowell & Dowell

[57] ABSTRACT

A module electrical connector including a box or housing having one side wall which is yieldable and which includes openings for receiving projections carried by female connectors which are insertable within the box. The box also includes an end wall having a notch for receiving opposed flanges extending from a female connector. The female connectors are interlocked by incorporating a series of notches in the upper and lower portions thereof with the upper notches being engaged by opposite flanges of an adjacent female connector and the lower notches being engagable by projections carried by an adjacent female connector.

6 Claims, 2 Drawing Sheets

MODULAR CONNECTOR SYSTEM

BACKGROUND OF THE INVENTION

1. Field of the Invention

The present invention concerns a modular connector system, whose new construction, conformation and design features fulfill the aim for which they have been specifically designed with maximum safety and efficiency.

The proposed invention relates to the area of electrical wiring intended for automotive vehicles and their connections, and carries out the function of centralizing a set of male and female connectors in a limited space and in an organized manner.

SUMMARY OF THE INVENTION

The proposed modular system, in addition, relates to an aspect of crucial importance in this area which is the speed of assembly and disassembly in which the centralization of the male and female terminals is provided in such a way that not only is it easy to include the terminals on the inside of the connectors, but the system also allows for greater ease for locating malfunctions, since, as its name indicates, the system is modular i.e., various connectors are grouped on the inside of a housing or box.

The proposed system includes a box or housing which acts as a container for female connectors and makes use of the corresponding means for retaining them. Each female connector houses the female elements or terminals, and each connector is linked to the adjoining female connector, also making use of corresponding means of retention with respect to the box.

Other details and features of the present application will become clear during the description which follows, wherein reference is made to the drawings that accompany the specification which provide, in a somewhat schematic manner, the preferred details. These details are given by way of example in referring to an embodiment, but this is not limited to the details which are set forth therein and therefore, this description should be seen as designed to illustrate without any kind of limitation.

DESCRIPTION OF THE PREFERRED EMBODIMENT

Figure 1:
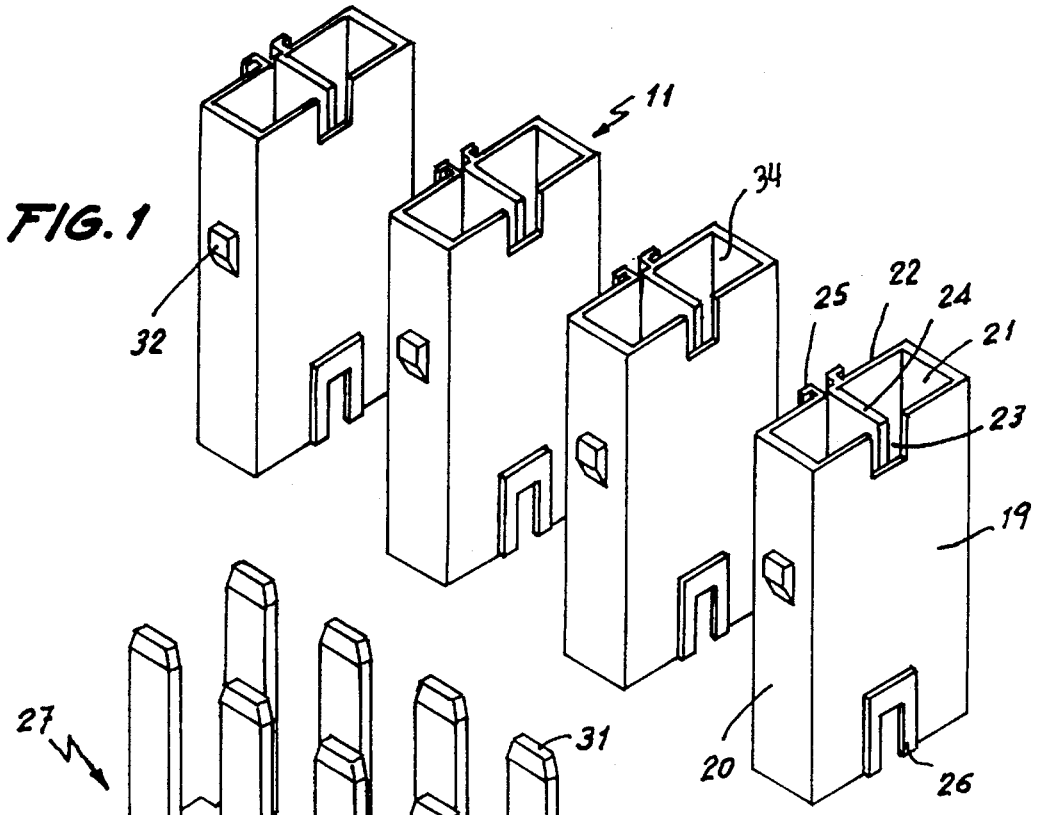
FIG. 1 is a perspective view of a number of female connectors.
Figure 2:
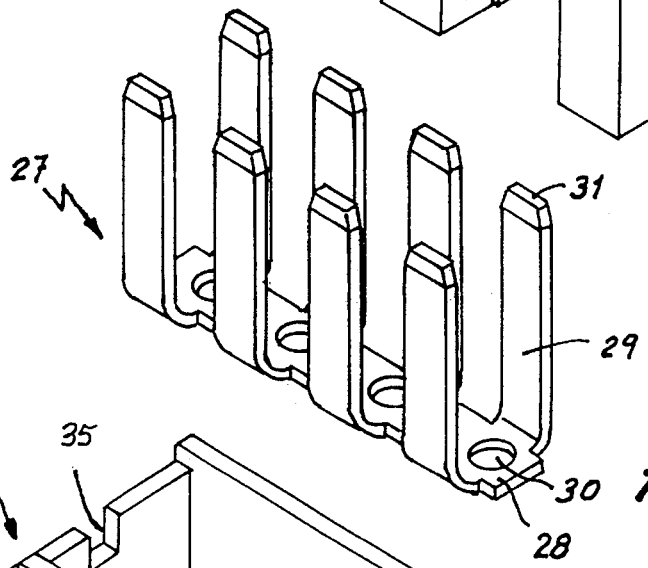
FIG. 2 is a perspective view of a male terminal provided with a plurality of spaced contact arms.
Figure 3:
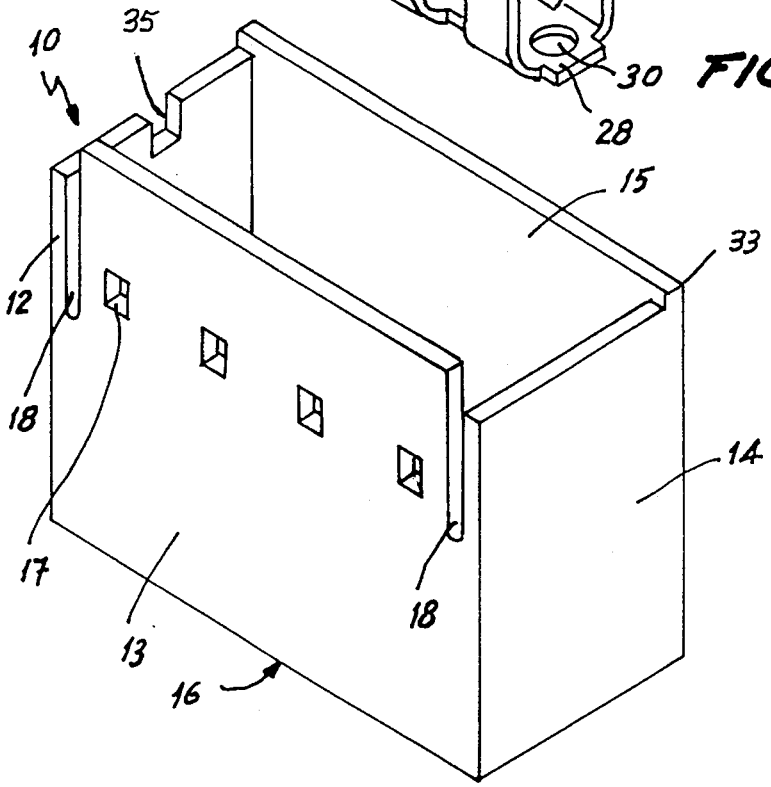
FIG. 3 is a perspective view of a box inside of which are housed the male terminal and the female connectors thereby forming a module.
Figure 4:
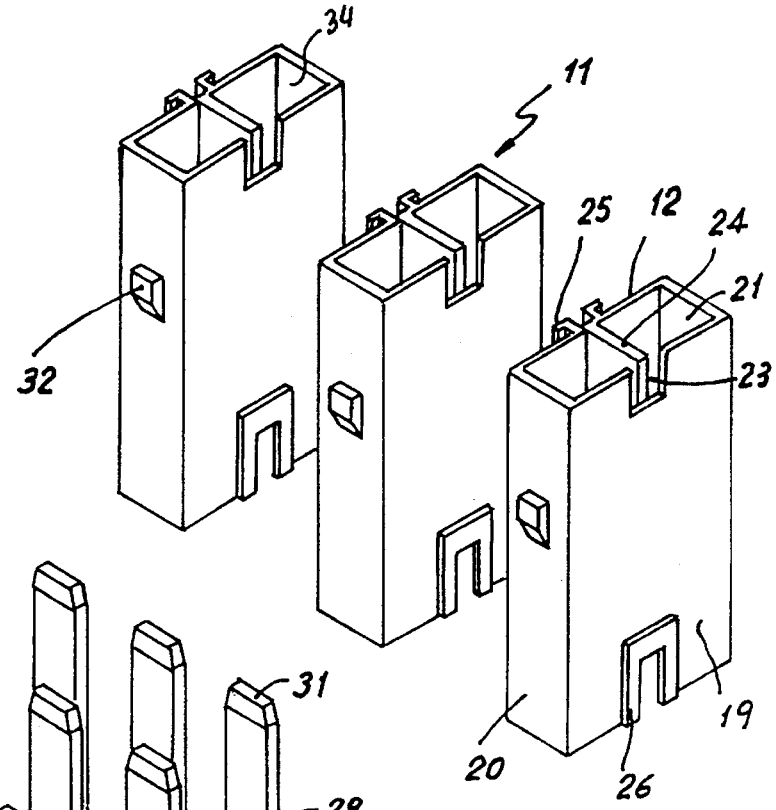
FIG. 4 is a perspective view of another embodiment showing three female modules.
Figure 5:
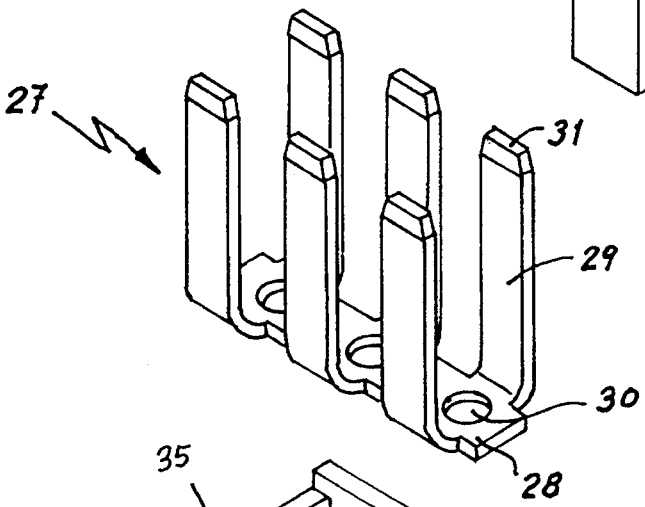
FIG. 5 is a perspective view of a male terminal equipped for use with the female connectors of FIG. 4.
Figure 6:
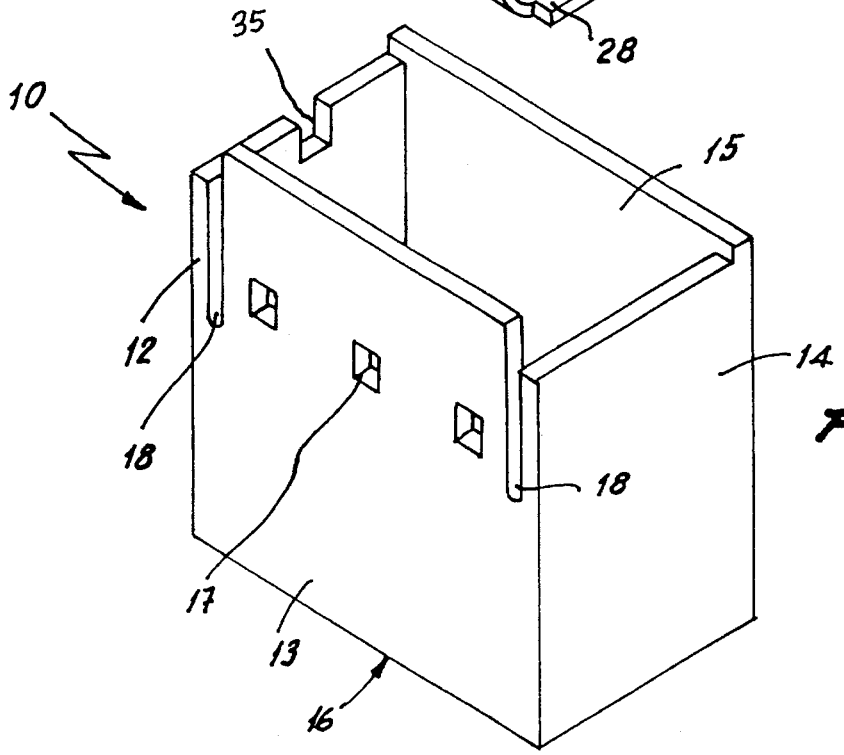
FIG. 6 is a box which is smaller than that shown in FIG. 3 and houses the male terminal and the female connectors of FIGS. 4 and 5.

In one of the preferred embodiments of the present application, a module 10 is comprised of a box 33 of standard measurement inside of which and on the lower base 16 a male terminal 27 is connected on its flat base 28 by means of corresponding rivets which extend through bores 30. The box is designed to receive female connectors 11 which contain corresponding female terminals, not shown. The female connectors are inserted in the interior or chamber of the box.

The boxes 33 are of a noticeably rectangular configuration with the upper portion open and with a flat lower base 16 from which two larger side walls 13 and 15 and two smaller end walls 12 and 14 extend. Located in the upper middle of side wall 13 are a plurality of openings or windows 17, the function of which, in cooperation with locking projections 32 of the female connectors, retain the connectors 11 on the inside of the boxes.

Wall 13, in contrast to end walls 12 and 14, includes spaces or slots 18, and end wall 12 includes a notch 35 into which a pair of oppositely oriented channel members 25 extending from a female are slideably received so as to connect one of the connectors 11 to the end wall 12.

The female connectors 11 are of a noticeably rectangular configuration having open upper and lower portions and are formed by two smaller side walls 20 and 21, and two larger end walls 19 and 22. Extending perpendicularly from the large end wall 22 is a partition 24 which divides the interior of the connector into two cavities 34. The larger end wall 19 contains a slot or notch 23 in its upper portion and a window or notch 26 in the lower portion which allows for the assembly of the connector over the contact arms 29 of the male terminal 27.

Extending from the upper middle section of the larger end wall 22 are the oppositely oriented channels 25 which allow for the attachment of one connector 11 to the notch 23 of an adjacent connector while, at the same time, a lower projection or stop 36, which is shown in dotted line in the drawings and which is formed by a small projection located in the lower middle section of the larger end wall 22, fits into the window or slot 26.

The novelty in this system is in the manner of joining and inserting the two-way connectors 11 so as to create two-way, four-way, six-way, eight-way or more complex modules.

The system is formed by the projections 32 and 36 and windows or slots 17 and 26 which hold the connectors 11 in place with the help of the channels 25 and thereby create a compact system, easy to assemble and in which a specific terminal or conductor is easily located. The connectors 11 are removable from the inside of the box 33 by outward pressure on the side wall 13 which is taller than wall 15, the wall 13 also having a certain amount of flexibility because of the spaced slots 18.

After observing the drawings and following the explanation of them provided, it will be seen that the application provides a simple and effective construction which may be put into practice with great ease, constituting without any doubt a new industrial result.

It is stated for whichever purpose that it may be deemed necessary that all those variations and modifications and details which circumstances and practice may bring about may be introduced in the object which makes up the current application, provided the essential quality which is summarized in the following claims is not altered or modified.

I claim:

1. modular electrical connector comprising:

a box having a base with opposing side and end walls extending generally perpendicularly from said base, said opposing side and end walls having upper portions defining an open top, a male electrical terminal mounted within said box and having a plurality of spaced pairs of contact arms extending toward said open top from said base;

a pair of spaced slots in one of said side walls extending from said upper portion towards said base so that said one of said side walls is resiliently yieldable between said slots, a plurality of spaced openings through said one of said side walls and between said slots, a plurality of female connectors each having a pair of generally parallel channels therein in which female electrical contacts may be mounted, each female connector having opposing and spaced side and end walls and being of a configuration to be receivable within said box so that a pair of spaced arms of said male electrical connectors are received within said pair of channels, respectively, said opposing and spaced side and end walls of said female connectors having upper and lower portions, each of said female connectors having a first locking protection extending from one of said side walls of said female connector, of a size to be engaged within one of said spaced openings in said one of said side walls of said box to thereby retain said female connectors within said box.

2. The modular electrical connector of claim 1 in which one of said end walls of said box includes a first open notch extending from said upper portion thereof, said female connectors having a pair of oppositely oriented channel members extending from the upper portion of one of said end walls thereof, said channel members being spaced so as %o be selectively receivable within said first open notch of said box.

3. The modular electrical connector of claim 2 wherein each of said female connectors includes a second open notch in the other end wall adjacent the upper portion thereof, said oppositely oriented channel members of said female connectors being selectively receivable within said second open notches whereby said female electrical connectors may be joined in end-to-end relationship.

4. The modular electrical connector of claim 3 wherein each of said female connectors includes a third open notch in said lower portion of said other of said end walls, and a second locking projection extending from each of said female connectors adjacent said lower portion of said one of said end walls, said second locking projection being selectively engageable within said third notch of an adjacent female connector when said female connectors are mounted within said box.

5. The modular electrical connector of claim 1 in which each of said female connectors has a pair of oppositely oriented channel members extending from one of said end walls thereof, each of said female connectors having an open notch in the other end wall adjacent the upper portion thereof, said oppositely oriented channel members of said female connectors being selectively receivable within said open notches whereby said female electrical connectors may be joined in end-to-end relationship.

6. The modular electrical connector of claim 5 wherein each of said female connectors includes another open notch in said lower portion of said other of said end walls, and a second locking projection extending from each of said female connectors adjacent said lower portion of said one of said end walls, said second locking projection being selectively engageable within said another open notch of an adjacent female connector when said female connectors are mounted within said box.

* * * * *